US007694627B2

(12) United States Patent
Koekemoer et al.

(10) Patent No.: US 7,694,627 B2
(45) Date of Patent: Apr. 13, 2010

(54) BLAST SEQUENCE CONTROL

(75) Inventors: Andre Louis Koekemoer, Boltsburg (ZA); Albertus Abraham Labuschagne, Brakpan (ZA)

(73) Assignee: Detnet South Africa (Pty) Ltd. (ZA)

( * ) Notice: Subject to any disclaimer, the term of this patent is extended or adjusted under 35 U.S.C. 154(b) by 706 days.

(21) Appl. No.: 10/564,622

(22) PCT Filed: Jul. 13, 2004

(86) PCT No.: PCT/ZA2004/000079

§ 371 (c)(1),
(2), (4) Date: Mar. 7, 2007

(87) PCT Pub. No.: WO2005/008169

PCT Pub. Date: Jan. 27, 2005

(65) Prior Publication Data

US 2008/0041260 A1 Feb. 21, 2008

(30) Foreign Application Priority Data

Jul. 18, 2003 (ZA) ..... 03/5560

(51) Int. Cl.
*F23Q 7/02* (2006.01)

(52) U.S. Cl. ..... 102/217; 102/206; 102/301; 102/311; 102/312; 102/313; 102/320

(58) Field of Classification Search ..... 102/217, 102/206, 301, 311, 312, 313, 314, 320; 299/13
See application file for complete search history.

(56) References Cited

U.S. PATENT DOCUMENTS

| | | | | |
|---|---|---|---|---|
| 5,295,438 | A * | 3/1994 | Hill et al. | 102/217 |
| 5,894,103 | A | 4/1999 | Shann | 102/215 |
| 6,422,147 | B1 * | 7/2002 | Shann | 102/312 |
| 6,536,798 | B1 * | 3/2003 | Hamilton | 280/735 |
| 6,644,202 | B1 * | 11/2003 | Duniam et al. | 102/312 |
| 6,945,174 | B2 * | 9/2005 | Aebi et al. | 102/301 |
| 7,578,237 | B2 * | 8/2009 | Johnston et al. | 102/217 |

FOREIGN PATENT DOCUMENTS

| | | |
|---|---|---|
| EP | 0 601 831 A | 6/1994 |
| EP | 0 897 098 A | 2/1999 |
| WO | WO 00/04337 | 1/2000 |

OTHER PUBLICATIONS

Invitation to Pay Additional Fees and Partial International Search Report for PCT/ZA2004/000079, mailed Dec. 9, 2004, 6 pages.
International Preliminary Examination Report on Patentability for PCT/ZA2004/000079, mailed Oct. 10, 2005, 10 pages.

* cited by examiner

*Primary Examiner*—Bret Hayes
*Assistant Examiner*—Michael D David
(74) *Attorney, Agent, or Firm*—Cantor Colburn LLP

(57) ABSTRACT

A marker for use in a blasting system which includes a harness, the marker including a control unit, a memory in which information is stored and a connector for connection to a selected location on the harness whereby, upon receipt of an enabling signal via the harness, the information is made available by the control unit.

15 Claims, 7 Drawing Sheets

BLAST SEQUENCE CONTROL

BACKGROUND OF THE INVENTION

This invention relates to a blasting system, to a method of controlling the blasting or initiation of a plurality of detonators in a blasting system, and to a marker for use in a blasting system.

Detonators are often connected to one another in a predetermined sequence and programmed so that each detonator is initiated at a predetermined time relative to other detonators in the sequence. A preset time difference may prevail between adjacent detonators in the sequence but this time difference can be dependent on a geographical or physical pattern in which the detonators are positioned or on geological factors such as the nature of the rock in which the detonators are placed. More generally it can be said that parameters of a blasting system such as a detonator layout or configuration or a timing sequence are influenced by the environment in which the detonators are used. For example in an underground situation particular physical and timing blasting patterns may apply in respect of detonators which are in a stope as opposed to detonators which are in a gully.

A practical difficulty which can arise at least in this connection when a complex blasting pattern is used, or when there are a large number of detonators in a blasting system, is the formulation by a user of a visual depiction of the interconnected detonators in a manner which facilitates the correct implementation of a desired blast sequence. For example at what location must time delays, assigned to the detonators, be changed? Where does a row or branch of detonators start, or finish? Where, in a blast structure, does use start or stop of a particular type or class of detonator? and so on.

SUMMARY OF INVENTION

The invention provides a method of establishing a blasting system in which a plurality of detonators are connected in a predetermined sequence which includes the step of indicating at least one location in the sequence whereby at least a first detonator in the sequence is distinguished from at least a second detonator in the sequence.

The location may be indicated by providing a marker at the location. Preferably it is possible to interrogate, or communicate with, the marker from a remote location eg. to identify or establish the existence of the marker, or data which is associated with the marker.

The detonators may be connected to a harness and the marker may also be connected to the harness.

The location may be a physical location in an area in which the detonators are used, or a notional location in the sense that the marker is used to identify or distinguish a detonator or detonators in the sequence.

The method may include the step of configuring the first detonator differently from the second detonator.

The word "configuring" relates to any attribute or parameter of or relating to a detonator or of the blasting system. For example the first detonator can be initiated differently from the second detonator or the remaining detonators. The first detonator may have a timing delay which differs from a timing delay of the second detonator; the first detonator may be of a different type or kind to the second detonator; the first and second detonators may be identical but have leads (harnesses) of different lengths connected to them, and so on.

It is also possible for the first detonator to be distinguished from the second detonator on the basis that the first detonator is associated with a change in a physical pattern or layout in the blasting system eg. a transition between a trunk or main line and a branch line, or a boundary between one group of detonators and another group of detonators which, possibly, are of a different type or which function differently.

The first detonator may be distinguished from the second detonator on the basis that the first detonator is associated with a geological feature in rock or terrain in which the blasting system is established, or with an end of a detonator string, or the like, or that the second detonator is associated with a geological feature, or with a start of a detonator string, or the like.

The invention is not restricted as to the function or purpose or basis of distinguishing one detonator from another, in the aforementioned manner.

The sequence of detonators may extend over at least two zones in which different types of blasting control are to be exercised. The nature of the blasting control may be influenced by different factors such as the actual or notional detonator deployment direction, physical conditions in which the detonators are used and rock types in which the detonators are placed. Thus the detonators in each zone may be initiated in a respective manner which takes account of the characteristics in, and the requirements of, that zone.

Each zone may be demarcated, in the blasting sequence, by indicating or marking at least two locations which are spaced from each other in the detonator sequence.

The detonator sequence may be configured so that the zones follow one another successively in a geographical sense, or in an electrical or blasting sense, or so that at least one zone extends, in the form of a branch line, or a row, of detonators, from a main or trunk line of detonators.

In a variation of the invention the indicated location designates a transition in the detonator sequence wherein detonators after the location are arranged in two or more zones which extend, from the location, independently of each other. Thus the indicated location may be associated with a splitting action in the detonator sequence which can give rise to one or more rows, branches or other detonator sequence configurations, which can extend, essentially in parallel to one another, from the location.

The invention also extends to a marker for use in a blasting system which includes a harness, the marker including a control unit, a memory in which information is stored and a connector for connection to a selected location on the harness whereby, upon receipt of an enabling signal via the harness, the information is made available by the control unit.

The information which is stored may vary according to requirement and may relate at least to one or more of the following:

a) the identity of the marker, b) a class or category to which the marker belongs;

c) the type of marker;

d) a timing period for a detonator;

e) information relating to a geological feature in an area in which the blasting system is established or used;

f) information relating to a configuration or pattern of the blasting system; and g) information relating to a designated feature in the blasting system, such as a split in a blasting sequence, a transition between a trunk or main line and a branch line, or a detonator row, in the blasting system, a position at an end, or at a beginning, of a detonator string, or the like.

The information may alternatively comprise a pointer to a location in an external device, eg. a blast controller, at which any of the aforementioned information is accessible.

The pointer may be a code which is associated with and which specifies particular blast information or it may designate an address at which the required blast information is to be accessed.

The information may alternatively comprise a prompt to initiate a decision, relating to the blasting system, from an operator or a blast controller or an equivalent controlling or programming device.

The information may be made available via the harness although it is also possible to make the information available using wireless techniques eg. by means of a radio or other transmitter.

The invention also covers a marking apparatus which includes a housing and a plurality of markers, each marker being of the aforementioned kind, in or on the housing. Connectors, for making electrical connections to the markers, may be included in the apparatus which may carry signage or indicators to facilitate the making of such connections and to illustrate the purpose thereof.

In one preferred form of the marking apparatus, the housing includes first and second markers which respectively designate a start and an end of a branch line which incorporates one or more detonators. The housing may have a first connector for connection to an incoming line, a second connector for connection to an outgoing line, and a third connector for connection to the branch line. Connections may be effected, preferably within the housing, for designated conductors in the respective lines between the markers and the connectors.

In another preferred form of the marking apparatus, the housing has first, second and third markers arranged so that the first and second markers respectively designate a start and an end of a first line which incorporates a first row of detonators, and so that the second and third markers respectively designate a start and an end of a second line which incorporates a second row of detonators.

With this form of the invention the housing may have a first connector for connection to an incoming line, a second connector for connection to an outgoing line, a third connector for connection to the first line, and a fourth connector for connection to the second line, with connections, internally of the housing, for designated conductors in the respective lines, between the markers and the connectors.

The invention also extends to a blasting system which includes a plurality of detonators which are connected in a predetermined sequence and at least one marker, at a defined location in the sequence, which enables at least a first detonator in the sequence to be distinguished from at least a second detonator in the sequence.

The marker may be a marker of the aforementioned kind.

The blasting system may include at least two markers which respectively define opposed boundaries, in a blasting sense, of a zone. Adjacent zones may be separated from each other, in a blasting sense, by respective blast markers.

The blasting system may be configured in a variety of ways, according to requirement, and the invention is not limited in this regard. In one example of the invention the blasting system is configured in the form of a main line of detonators with at least one branch line of detonators which extends from a main line of detonators, and a respective marker is positioned at a junction between the main line and each respective branch line.

The blasting system may be implemented using marking apparatus of the aforementioned kind, to designate or configure branch lines or row lines as required.

In a different form of the invention the blasting system is configured so that the detonators extend from a marker connected to a main line in a plurality of lines with each line of detonators extending over a respective defined zone. The plurality of lines, in an electrical or blasting sense, may be parallel to one another.

Through the use of the markers and the marking apparatus it becomes possible to generate a graphical depiction of a detonator array which may be of a complex nature particularly if it includes a large number of detonators, a capability which can considerably facilitate the configuration or implementation of a blasting structure, for inter alia the graphical depiction allows an operator to associate particular detonators with geographical features, time delays, harness lengths, etc.

BRIEF DESCRIPTION OF THE DRAWINGS

The invention is further described by way of examples with reference to the accompanying drawings in which.

DESCRIPTION OF PREFERRED EMBODIMENTS

Figure 1:
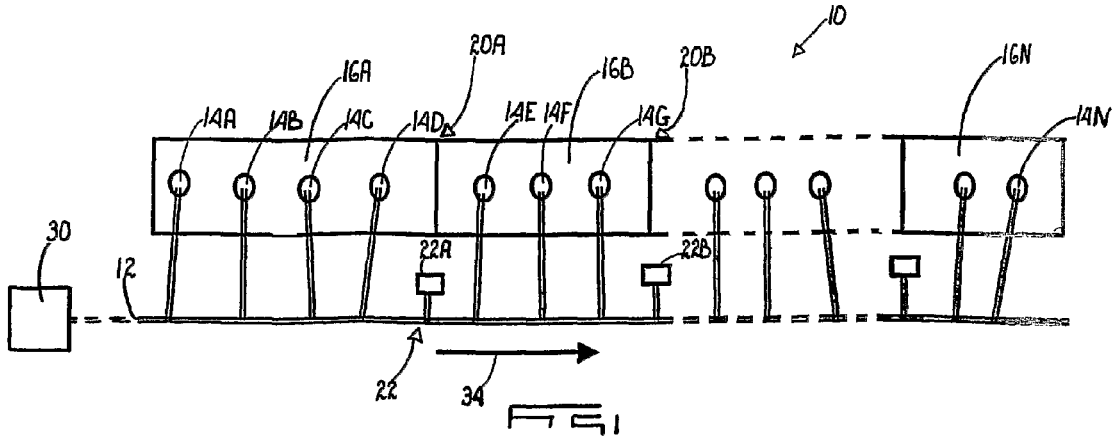
FIG. 1 is a schematic representation of a blasting system according to the invention in a first configuration.

FIG. 1 of the accompanying drawings illustrates a blasting system 10 according to the invention which includes a blasting bus or harness 12 to which are sequentially connected a plurality of detonators 14A, 14B . . . 14N in a predetermined manner.

The detonators are grouped in zones 16A, 16B . . . 16N. Adjacent zones, in FIG. 1, border each other on boundary locations 20. In this instance the detonators 14A to 14D are in the zone 16A, the detonators 14E to 14G are in the zone 16B, and so on. Each zone is represented, purely for ease of reference, by a rectangular block. In practice each zone is defined or formed by the characteristics of the environment in which blasting is to take place. For example the zone 16A may have hard rock while the zone 16B may have a softer rock. Another possibility is that one zone may be located in a gully or a relatively large underground excavation while an adjacent zone may be located in a stope or a relatively restricted or confined underground excavation. Alternatively a zone could include a plurality of detonators which are grouped together for graphical or illustrative purposes to enable a user to form a visual impression of a detonator layout, or blasting pattern, more readily. This aspect is further described hereinafter. These examples are merely illustrative and are not limiting. In general it can be said that the blasting requirement in a first zone, typically as embodied in the time delays attributed to the individual detonators in the first zone but not confined to this aspect, is different from the blasting requirement in an adjacent second zone which is separated from the first zone by a marker, as described herein.

Each boundary or transition location 20 between adjacent zones is marked by a blast marker 22. In FIG. 1 a boundary location 20A is formed between the zones 16A and 16B and is marked by a blast marker 22A. The boundary location 20B between the second and third zones is marked by a blast marker 22B, and so on down the sequence of detonators.

The blasting harness 12 is connected to a blast controller 30 of known construction. The blast controller is used to give firing signals to the individual detonators and to provide electrical energy to the detonators which enables initiation of the detonators to take place under controlled conditions. A possible blast direction is designated by an arrow 34 which indicates that, in this example, sequential indication of the detonators would place in a direction along the harness 12 which extends away from the blast controller 30.

Figure 2:
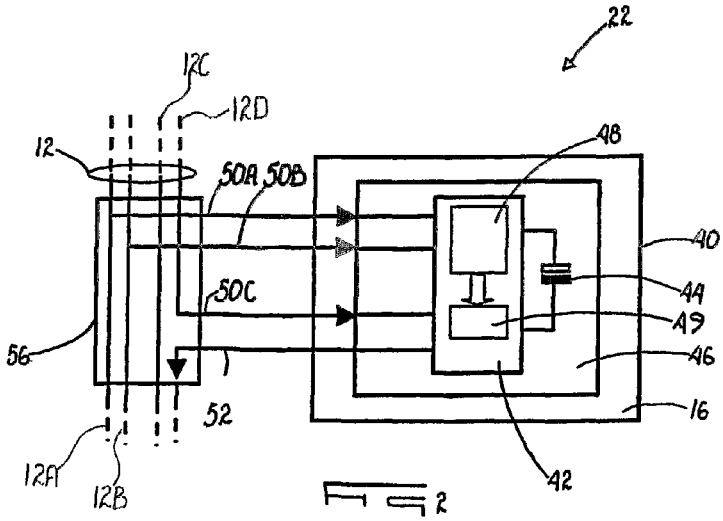
FIG. 2 illustrates a blast marker which is suitable for use in the blasting system of the invention.

FIG. 2 illustrates a blast marker 22 which includes a housing 40 in which are mounted a control unit 42 in the form of a suitable control circuit or chip and a capacitor 44 which is used to provide energy to the unit 42. The unit 42 could be custom-designed or be part of a suitable detonator circuit without a fuse or bridge, which is adapted for use in the blast marker. The unit 42 and capacitor are mounted on a substrate such as a printed circuit board 46. The control unit includes at least a control or logic unit 48 and a memory device 49 which could be part of non-volatile memory of the control unit 42. The housing 40 may be of any appropriate shape or size and although the housing may be similar to a standard detonator case it preferably has a unique shape. The housing could be colour-coded, or identified in any other appropriate way, so that a function or functions which are associated with the blast marker are easily visually discernible. A marker housing could thus be application specific in the sense that, for example, a marker which is used to designate a branch, a row or other physical parameter of a blasting system could have a distinctive attribute such as a defined shape, colour or other features. These aspects are further described hereinafter.

The blast marker has inputs 50A, 50B and 50C respectively and an output 52. The inputs 50 and the outputs 52 are connected to the harness 12 using a connector 56 which is shown displaced from the housing 80 but which, typically, is connected to a socket or terminal which is fixed to, or which forms part of, the housing.

The various electrical components are encapsulated in the housing 40 using any suitable technique eg. a standard potting compound. Internal electrical connections are made within the housing to enable conductors 12A, 12B, 12C and 12D, in the harness to be automatically connected, via the connector 56, in a predetermined circuit configuration.

Typically, in the four wire (conductor) system illustrated, the conductors A and B are "shared" by all the detonators and form a primary power and communications link from and to the blast controller. The C and D conductors are used to serially interconnect adjacent detonators in what is referred to as a "daisy chain".

The type of connector 56, although preferably standard, is chosen so that it is compatible with connectors, not shown, which are used to connect the detonators 14 (shown in FIG. 1) to the harness 12.

Information, which is particular to the detonators in a given zone 16, is loaded into the memory of the blast marker 22 which precedes the zone. This information is determined taking into account the character and requirements of the following zone. Thus, referring to FIG. 1, the blast controller 30 is loaded with the information which determines the timing delays associated with the detonators in the zone 16A, the blast marker 22A has timing information related to delays which must be attributed to the detonators in the zone 16B and so on through the succession of zones in the blast direction 34.

In a different technique an address or code, referred to as a pointer, which relates to information eg. a location at which further information can be accessed, is loaded into the memory 49 in the marker. When the blast sequence programming operation reaches the marker the pointer designates an address at which the further information is to be accessed via the communications bus and that information is used in the following zone.

The further information is preferably stored at the blast controller, or at any suitable auxiliary device which can be used in conjunction with the blast controller and the designated location could then be an address of memory where the information is stored. Such information may be varied according to requirement and, for example, may relate to any of the following aspects:

a) the identity of the marker;
b) a class or category to which the marker belongs;
c) the type of marker;
d) a timing period for a detonator;
e) information relating to a geological feature in an area in which the blasting system is established or used;
f) information relating to a configuration or pattern of the blasting system;
g) information relating to a designated feature in the blasting system, such as a split in a blasting sequence, a transition between a trunk line and a branch line in the blasting system, a position at an end or beginning of a detonator string, or the like; and
h) information on a detonator type or product class.

As indicated each marker may be uniquely identified by identity data in the respective memory device 49 but this is not necessarily the case. Data, stored in the memory device, could designate a marker type, or marker class, without being capable of being used to distinguish a marker in a given class from another, similar marker in the same class. Thus, in a given blasting configuration, the markers can be used at each boundary location 20 to demarcate or separate an end or exit point of one zone from a beginning or entry point of an adjacent zone. This allows the blast controller to take the required action in programming the detonators in the sequence to cater for the specific needs or changes in blasting character in any blasting installation.

Alternatively, according to requirement, the markers could be used simply to designate transition points in a blasting system eg. respective junctions between branch lines and a trunk or main line, a beginning or end point in a detonator string or zone, a particular detonator, or the like.

The data or information in each marker can be accessed by transmitting a suitable interrogating signal on the harness to the marker. The signal is received by a receiver unit in the control unit 42, and, if the signal is validated by the unit 42, the data or information held in the storage device 49 is then transmitted via a communication unit in the control unit, on the harness, to the blast controller.

The user of a blasting system is therefore able with relative ease to install a complex blast pattern in a sequence where for example the character or deviation from a standard sequential installation requires timing changes. Also, by judicious use of markers, the user is easily able to obtain a graphical depiction of the layout or pattern of detonators in a complex blasting system which can include a large number of detonators.

It is convenient to use the harness to transmit data or information from a marker to the blast controller or any other device. Use could however be made of other techniques for the purpose and, for example, a marker could include a radio transmitter, in place of the transmitter referred to earlier, which transmits a radio signal containing the relevant data or information when the marker is correctly interrogated or addressed.

Figure 3:
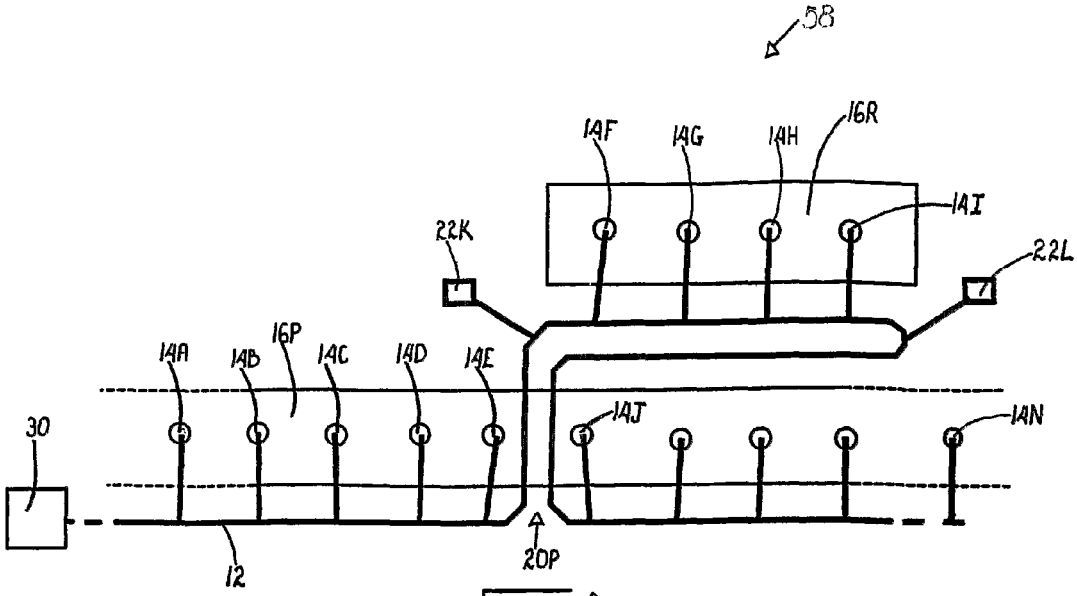
FIG. 3 illustrates a blasting system, according to the invention, in a different configuration from what is shown in FIG. 1.

FIG. 3 illustrates a blasting system 58 which is based on a modification of what has been described hereinbefore. Components shown in FIG. 3 which are similar to components already described bear like reference numerals and are not further described herein.

The blasting system 58 is suited for use under conditions where a zone 16P which includes a plurality of detonators 14A to 14E and 14J to 14N needs to be interrupted to serve an anomalous zone 16R without exerting an adverse influence on a blasting routine which is required for the detonators in the zone 16P.

The zone 16R includes detonators marked 14F to 14I which are directly connected to the wiring harness 12. A location 20P at which the zone 16R borders a first portion of the zone 16P is the same, in an electrical or blasting sense, as a location at which the zone 16R borders the remaining detonators in the zone 16P. The commencement of the zone 16R is designated by a marker 22K while a blast marker 22L marks the end of the zone 16R. The marker 22K is referred to herein as an "exit marker" while the marker 22L is referred to herein as a "return marker".

In this instance the marker 22K is used to indicate a change in installation parameters of the detonators in the blasting system and, more particularly, that a fresh or different set of timing rules are to be implemented.

As has been stated hereinbefore the nature of the change in the installation parameters can be indicated by data which is associated with the marker in any appropriate way, for example, by being stored in a table in or which accessible by the blast controller, or by being stored in a memory device in the marker. Another possibility is that upon the detection of a marker, or a marker of a particular type, an installer or a person using the blast controller could be prompted to take suitable action eg. to decide on, and enter, timing requirements for a detonator or detonators which follow the marker i.e. which are on a "downstream" side of the marker. For example, in a particular application, the marker is used, directly or indirectly, to impart predetermined timing information to the detonators in the zone 16R while the marker 22L is used to ensure that the detonators 14J to 14N have different timing information to the detonators in the zone 16R. The detonators 14J to 14N could have the same timing information as the detonators 14A to 14E, or different timing information.

Figure 4:
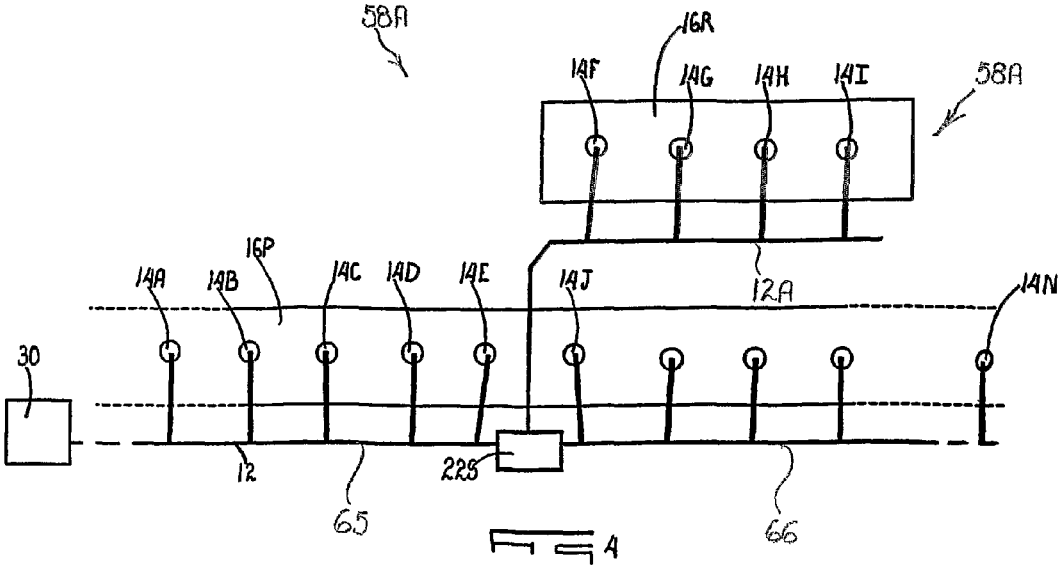
FIG. 4 shows the configuration of FIG. 3 in a modified layout.

The blasting system shown in FIG. 3 can be implemented, using the principles of the invention, in an alternative manner in a blasting system 58A which is shown in FIG. 4. Again, where applicable, like components are designated by like reference numerals and are not described in detail.

Detonators 14F to 14I in a zone 16R are separated from the remaining detonators by a marking apparatus 22S which is also referred to herein as a "splitter" or a "branch controller" and which combines the functions of the exit marker 22K and the return marker 22L shown in FIG. 3.

Figure 5:
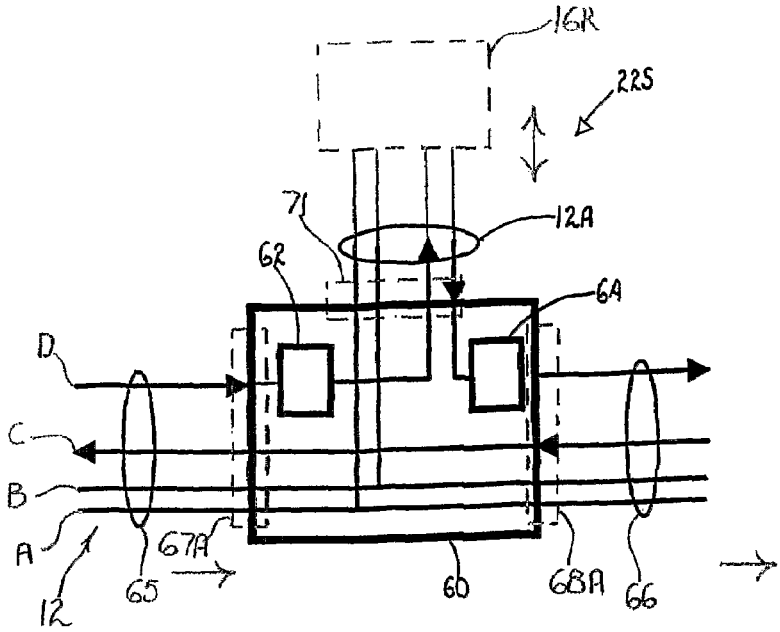
FIG. 5 depicts marking apparatus, also referred to as a branch controller, used for designating or forming a branch line in a detonator structure.
Figure 6:
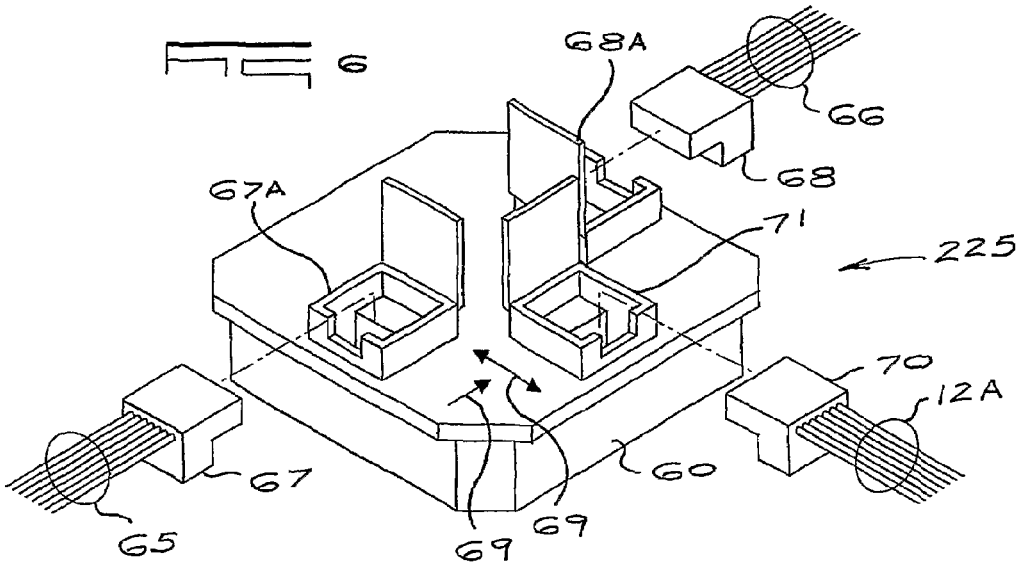
FIG. 6 is a physical illustration of one form of a branch controller.

A circuit configuration of the branch controller 22S is shown in FIG. 5 while FIG. 6 shows one possible physical form of the branch controller.

The branch controller includes a housing 60 which accommodates a device 62 which is equivalent to the exit marker and a device 64 which is equivalent to the return marker. The blast harness 12 has four conductors A, B, C and D which are severed to form an input line 65 and an output line 66. Respective terminals 67 and 68 are connected to the ends of the lines and are engageable with connector blocks 67A and 68A on the housing 60 which preferably includes markings 69 to allow the blocks to be easily distinguished from each other.

A branch line 12A which extends to the zone 16R is connected via a terminal 70 to a connector block 71 on the housing. Connections are made internally, in the housing, between the connectors 67A, 68A and 71, and the markers 62 and 64.

An enabling signal on the line 65 actuates the marker 62. If timing information is prestored in the marker, then this information can be imparted to the detonators 14F to 14I in the branch zone 16R which is established through the use of the splitter or branch controller 22S. A return conductor from the zone 16R goes to the marker 64 which functions in the way similar to what has been described in that an enabling signal received by the marker causes timing information to be imparted to the detonators 14J to 14N connected to the output line 66. This information can be the same as the timing information which is loaded into the detonators 14A to 14E, or it can differ therefrom. Communications lines A and B in the harness 12 are connected in parallel to all the detonators in the zones 16P and 16R.

If the timing information is not stored in the branch controller then a pointer or other data can be stored in the controller which is made available to the blast controller or an operator when the branch controller is interrogated so that appropriate action can be initiated eg. suitable timing information can be accessed and is then allocated to the respective detonators.

Thus, in more general terms, the detection of a marker and, optionally, the detection of a particular type of marker, is used to indicate or signal a change in an aspect of a blasting system. This notification can be used automatically by the blast controller, or by an operator who uses the blast controller, to influence an event or parameter which applies to the blasting system thereafter, eg. in a geographical or physical sense "downstream" of the marker.

Figure 7:
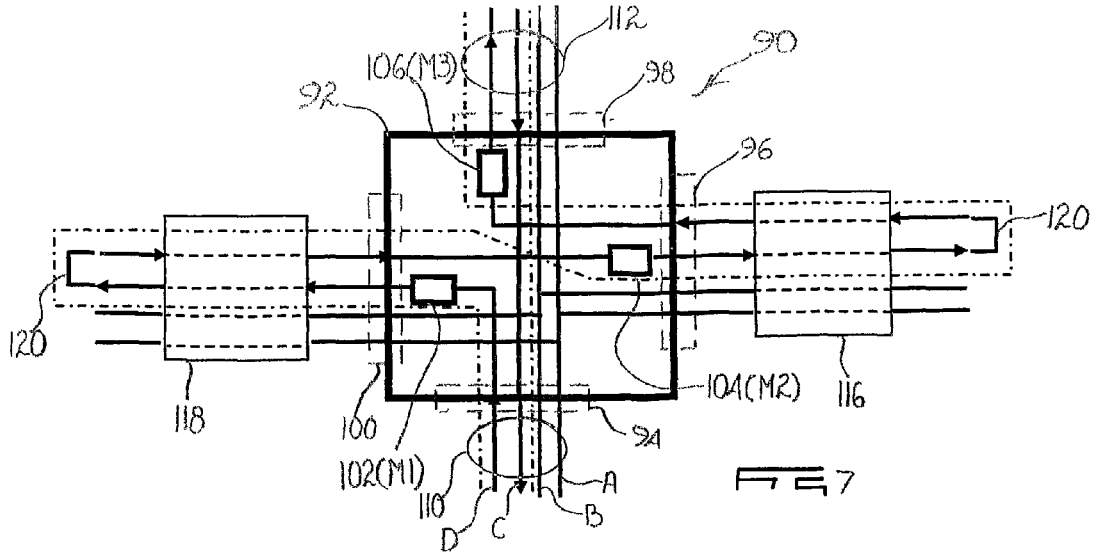
FIG. 7 shows marking apparatus, also referred to as a row controller, used for designating or forming two rows of detonators (eg. left and right) in a detonator sequence.
Figure 8:
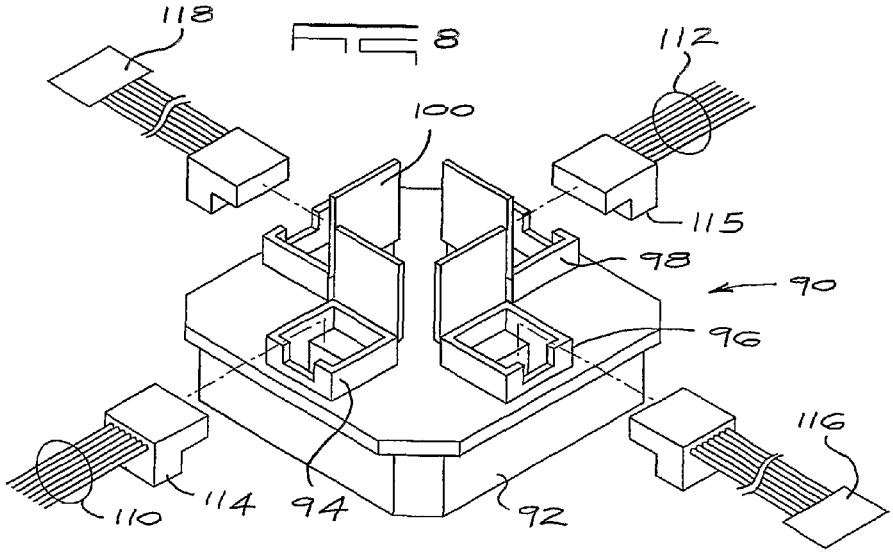
FIG. 8 is a physical depiction of one form of a row controller.
Figure 9:
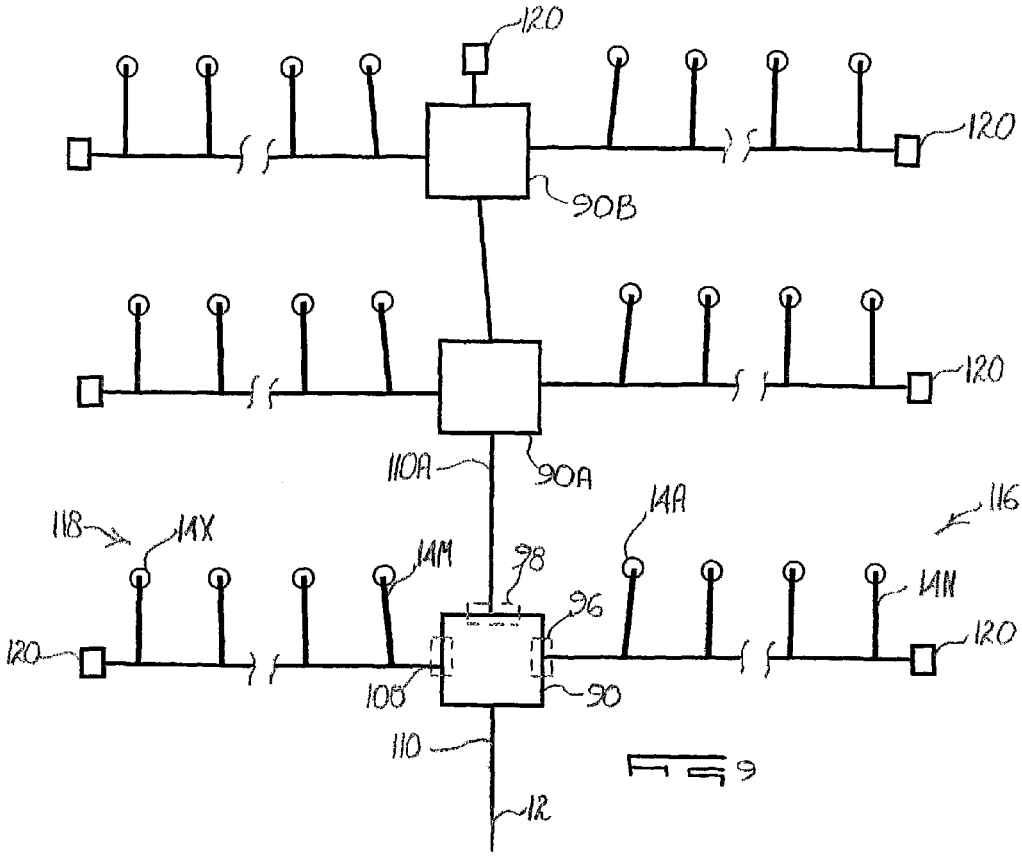
FIG. 9 is a graphical depiction of part of a blasting system established through the use of multiple row controllers.

FIGS. 7 to 9 illustrate a development or modification of the principles which have been described hereinbefore. FIG. 7 is a schematic electrical representation of marking apparatus 90, referred to herein as a row controller, while FIG. 8 shows the physical construction of a typical row controller. FIG. 9 is a graphical representation of part of a blast structure established through the use of a number of row controllers.

The row controller 90 includes a housing 92 which preferably has a unique shape or colour so that it can readily be distinguished from other components which are used in a blast sequence. Four connector blocks 94, 96, 98 and 100 respectively are positioned on an upper surface of the housing 92.

Markers 102, 104 and 106 respectively, each of which is substantially similar to the marker 22 shown in FIG. 2, are mounted inside the housing. Electrical connections are established internally in the housing between the markers and the connector blocks. The markers are not visible in FIG. 8 for they are normally enclosed in the housing. In FIG. 7 on the other hand the connector blocks are schematically represented in dotted outline only.

At a designated point in a blasting structure the harness 12 is severed to form an incoming line 110 and an outgoing line 112. Respective terminals 114 and 115 are connected to the conductors in the lines. Two rows of detonators are respectively connected to the connector block 96 and 100. The detonators which extend from the connector block 96 are referred to as a right row 116 which is shown schematically in FIG. 7. Similarly the detonators which extend from the connector block 100 are grouped in a left row 118 schematically shown in FIG. 7.

FIG. 9 shows part of the main line or harness 12 with the row controller 90 connected thereto. The row controller is followed by subsequent row controllers 90A and 90B. Clearly the outgoing line 112 constitutes an ingoing line 110A for the following controller 90A, and so on. The right row 116 includes a plurality of detonators 14A to 14N of any appropriate type. Similarly the left row 118 includes a plurality of detonators 14M to 14X of any appropriate type. Similar constructions are adopted for the rows established through the use of the other row controllers.

Referring particularly to FIG. 7 the connector blocks 94 and 98 form in and out connections which are connected to the main harness 12 or spine of the blast pattern. The connector block 96 allows a connection to be made to a detonator string which forms a right row 116 while, similarly, the connector block 100 allows connections to be made to a detonator string which forms a left row 118.

In the following diagram the row controller is represented by the symbol XO, a detonator is represented by the symbol D, the four-wire harness is represented by a "-" or "I" and a terminating plug by the letter T. The terminating plug, designated 120 in FIG. 9, is used at an end of a detonator string or row to effect a return connection between the respective conductors C and D and thereby establish electrical continuity in the blasting sequence.

Diagram

```
        To Blast Controller 30
                  |
L1   T-D-D-D-D-D-XO-D-D-D-D-D-D-D-D-D-D-T    R1
                  |
L2     T-D-D-D-D-XO-D-D-D-D-D-D-D-D-D-D-D-T  R2
                  |
L3   T-D-D-D-D-D-XO-D-D-D-D-D-D-D-D-D-D-T  R3
                  |
                  T
```

In the diagram there are three right rows designated R1 to R3 and three left rows L1 to L3 respectively. Referring only to the left row L1 and the right row R1 it is possible to number the respective detonators in a sequential fashion rather than designating them with the letter D. The two rows L1 and R1 are then represented as follows:

T-5-4-3-2-1-XO-6-7-8-9-10-11-12-13-14-15-16-T

If the markers (eg. 102 to 106 in FIG. 7) are now represented by the symbols M1, M2 and M3 respectively then the components (markers and detonators) in the left and right rows are represented as follows:

M1-1-2-3-4-5-M2-6-7-8-9-10-11-12-13-14-15-16-M3

The detonators (1 to 5) in the left leg L1 are located, in order, between the first marker M1 and the second marker M2. The detonators (6 to 16) in the right leg R1 are located between the markers M2 and M3. Even though the detonators are electrically interconnected in a single long consecutive train the presence of the markers in the chain and the physical wiring layout in the row controller allow the blast controller to determine the wiring order and to build-up a picture of the blast configuration. This is an important feature which is further described hereinafter.

The blast controller 30, when interrogating a row controller, branch controller or, more generally, any marker, can read "product class" information from the respective memory device in the interrogated marker. As indicated this type of information can enable the blast controller to determine information which affects the blast structure eg. that the left row L1 should have detonators with harnesses of a first length whereas the detonators in the right R1 should have harnesses with a different length.

It is clear that, depending on the type of detonator employed in a blasting system, the use of the markers allows one group or zone of detonators to be distinguished from another even though the detonators do not necessarily have unique identity numbers or data associated with them but, if this type of information or data is associated with the detonators then the incorporation of the markers, in a blasting structure, does not impede or restrict the usefulness of such data.

Referring again to FIG. 5, it is evident that the incoming harness 12 is split into two serviceable outputs namely a branch line 12A and a continuation of the incoming main line i.e. the output line 66.

The splitting concept can be used for multiple branch splitting by connecting and assigning a number of exit markers in a blasting sequence. Each exit marker is then an identifier for each branch which exits the splitter or branch controller. Each branch can then be dealt with as a separate zone similar to what has been described hereinbefore. A marker which designates a splitter or a branch resulting from a split can directly impart timing or other information, which is applicable to particular detonators, or it can be used to notify a blast controller, or an operator, to generate or otherwise to determine information which relates to particular detonators.

Figure 10:
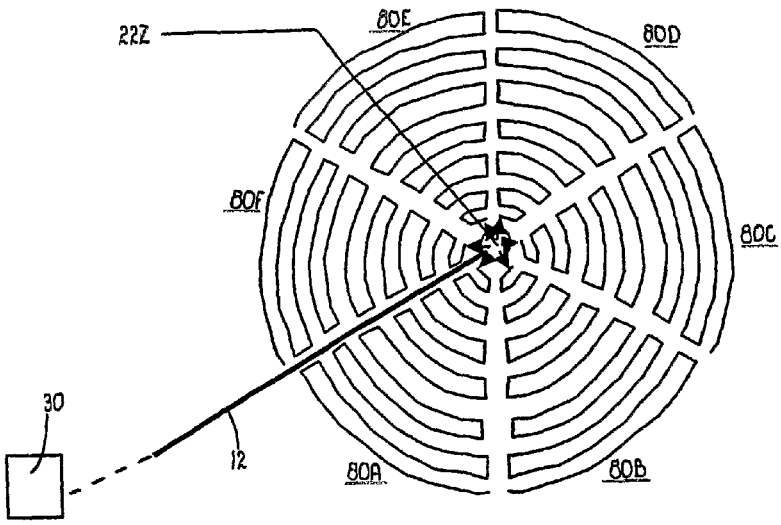
FIGS. 10 and 11 are respectively geographical and electrical representations of a blasting system according to the invention in what is referred to herein as a "hub" configuration.
Figure 11:
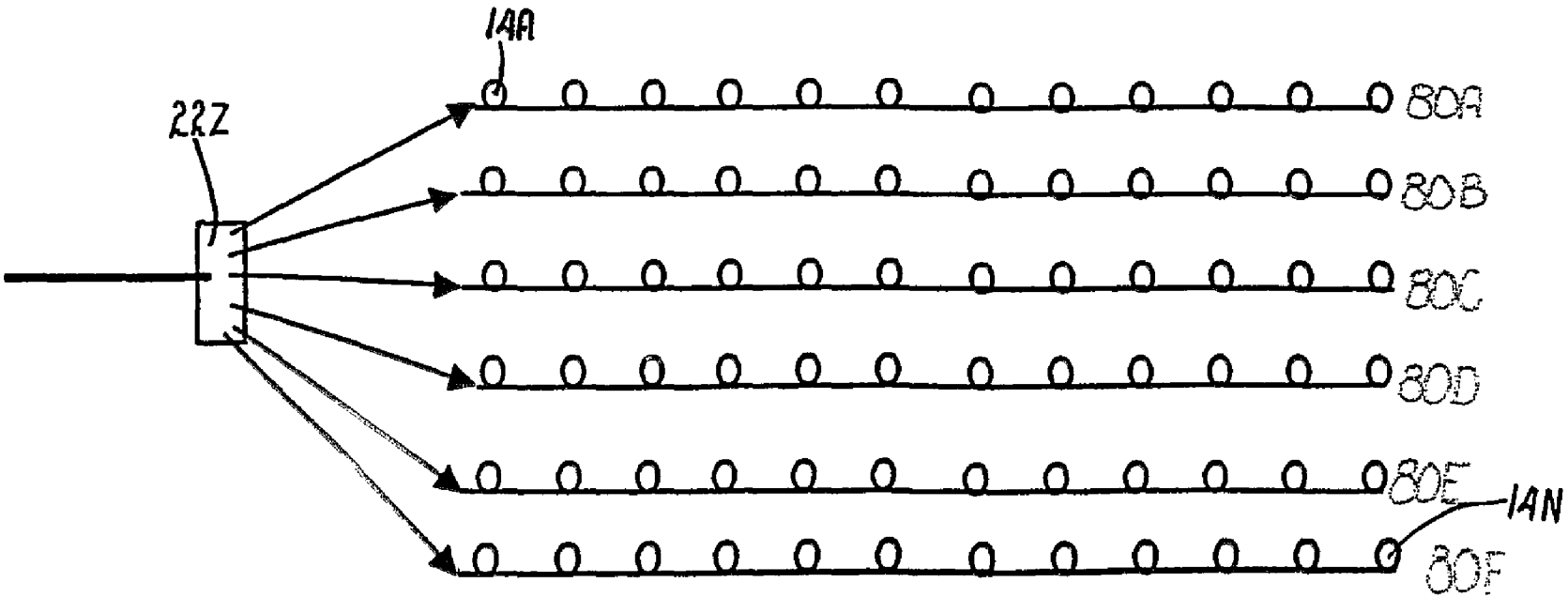

FIGS. 10 and 11 illustrate a variation of the aforementioned principle. In this case zone or blast markers are used in a daisy chain hub 22Z. FIG. 10 is a geographical representation of a desired blasting layout while FIG. 11 is an electrical representation of the blasting system. The hub is connected via a blast harness 12 to a suitable blast controller 30.

The layouts shown in FIGS. 10 and 11 are to be interpreted in conjunction and are particularly suitable for use in generating a circular blasting pattern eg. for sinking a circular shaft. FIG. 10 illustrates 6 zones designated 80A to 80F respectively, each of which is sector-shaped, arranged around the hub 22Z to form a composite circular shape. The detonators 14 which are employed in each of the zones are sequentially connected to one another as is indicated in the electrical representation shown in FIG. 11. Each zone 80 can be individually programmed with predetermined blast delays or a particular program developed for one zone can be repeated and then stepped to another zone at a defined offset in time.

The markers can be used to enable a user to form a graphical representation of a detonator layout or blast pattern, which may be based on or related to geographical, geological or other factors, in place of or in addition to, acting as an aid or trigger which allows blasting parameters such as timing delays to be directly or indirectly allocated or formulated.

Figure 12:
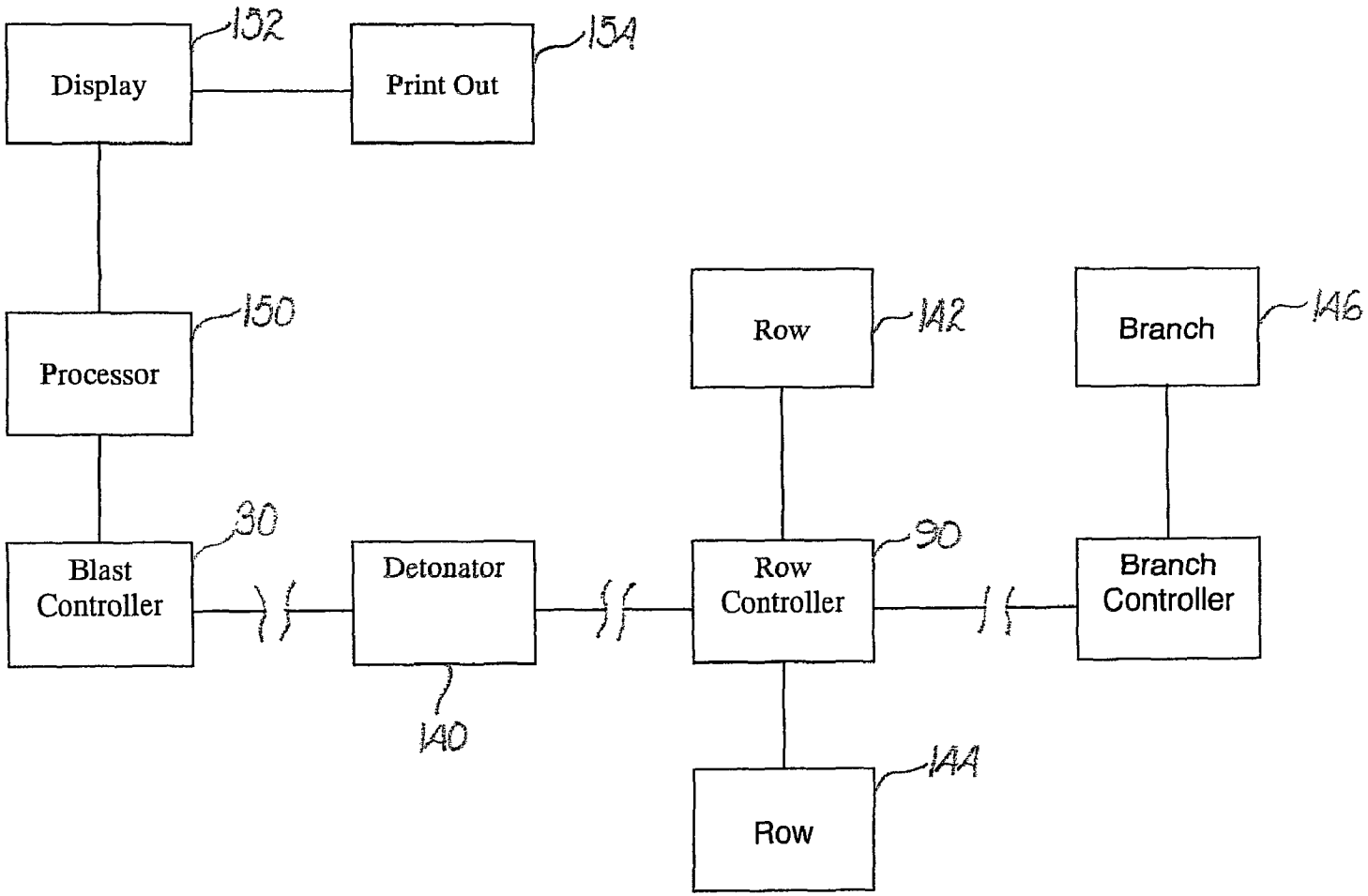
FIG. 12 schematically illustrates a blasting system which includes the capability to generate a graphical depiction of the blasting system based on the use of the markers of the invention.

The marker of the invention, whether used alone or incorporated into a branch controller or row controller or any other form, enables one or more detonators to be distinguished from one or more remaining detonators and also allows detonators in a geographical zone to be distinguished from detonators in a different geographical zone. A further significant benefit is that the markers enable an operator to form a graphical impression of the configuration in which the detonators are arranged. This is an important factor particularly in a complex blasting system which includes a large number of detonators which can be spread over a considerable area. FIG. 12 shows a blast controller 30 which is connected to a detonator string 140 and then to detonator rows 142 and 144 by means of a row controller 90 and to at least one branch line 146 of detonators by means of a branch controller 22S. The arrangement shown in FIG. 12 is purely by way of example for it is apparent that the markers and the branch and row controllers allow sophisticated and complex arrangements of detonators to be made with relative ease.

A processor 150 is connected to the blast controller. Information on the nature and function of each marker encountered in the blasting system, and on the types of detonators in each row or branch or string, is fed to the processor 150 which manipulates the data, according to predetermined criteria, to provide a graphical representation on a display screen 152 and, optionally, a printout of the representation via a suitable printer 154.

The nature of the representation could vary according to requirement and, merely by way of example, could be similar to what has been shown in FIG. 1, FIG. 4, FIG. 9 or FIG. 10.

The invention claimed is:

1. A method of establishing a blasting system in which a plurality of detonators are connected in a predetermined sequence in a consecutive train to an elongate harness which includes the steps of providing at least one marker between a first detonator in the sequence and a second detonator in the sequence thereby to distinguish the first detonator from the second detonator and interrogating the marker to establish information associated with the marker which information relates to at least one of the following:

a) a class or category to which the marker belongs;
b) the type of marker;
c) a timing period for a detonator;
d) information relating to a geological feature in an area in which the blasting system is established or used;
e) information relating to a configuration or pattern of the blasting system;
f) information relating to a designated feature in the blasting system; and
g) information relating to a detonator or a class of detonators.

2. A method according to claim 1 wherein the marker is interrogated from a remote point.

3. A method according to claim 1 which includes the step of forming a graphical representation of at least part of the blasting system using at least part of the information which is associated with the marker.

4. A method according to claim 1 wherein the location is selected from a physical location in an area in which the detonators are used and a notional location at which the marker is used to identify or distinguish a detonator or detonators in the sequence.

5. A method according to claim 1 which includes the step of configuring the first detonator differently from the second detonator.

6. A method according to claim 5 which includes the step of initiating the first detonator differently from the second detonator or the remaining detonators.

7. A method according to claim 5 which includes the step of assigning a time delay to the first detonator which differs from a time delay assigned to the second detonator.

8. A method according to claim 1 wherein the first detonator is distinguished from the second detonator on the basis that the first detonator is associated with a change in a physical pattern or layout in the blasting system.

9. A method according to claim 8 wherein the change in the physical pattern or layout is selected from a transition between a main line and a branch line and a boundary between one group of detonators and another group of detonators.

10. A method according to claim 1 wherein the first detonator is distinguished from the second detonator on the basis that the first detonator is associated with a geological feature in rock or terrain in which the blasting system is established, or with an end of a detonator string.

11. A method according to claim 1 wherein the sequence of detonators extends over at least two zones in which different types of blasting control are to be exercised and wherein the detonators in each zone are initiated in a respective manner which takes account of the characteristics in, and the requirements of, that zone.

12. A method according to claim 11 wherein each zone is demarcated in the blasting sequence by means of markers at least at two locations which are spaced from each other in the detonator sequence.

13. A method according to claim 12 wherein the detonator sequence is configured so that the zones follow one another successively in a geographical sense.

14. A method according to claim 12 wherein the detonator sequence is configured so that at least one zone extends, in the form of a branch line of detonators, from a main line of detonators.

15. A method according to claim 1 wherein the marker designates a transition in the detonator sequence wherein detonators after the marker are arranged in two or more zones which extend from the marker independently of each other.

* * * * *